US010259670B2

(12) United States Patent
Kotsuka et al.

(10) Patent No.: US 10,259,670 B2
(45) Date of Patent: Apr. 16, 2019

(54) SHEET CONVEYANCE DEVICE AND IMAGE FORMING APPARATUS

(71) Applicant: CANON KABUSHIKI KAISHA, Tokyo (JP)

(72) Inventors: Hideki Kotsuka, Yokohama (JP); Yohei Suzuki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 6 days.

(21) Appl. No.: 15/840,526

(22) Filed: Dec. 13, 2017

(65) Prior Publication Data

US 2018/0179005 A1 Jun. 28, 2018

(30) Foreign Application Priority Data

Dec. 26, 2016 (JP) ..... 2016-251835

(51) Int. Cl.
*B65H 5/06* (2006.01)
*B65H 5/38* (2006.01)

(52) U.S. Cl.
CPC ..... *B65H 5/062* (2013.01); *B65H 5/38* (2013.01); *B65H 5/06* (2013.01); *B65H 2402/531* (2013.01); *B65H 2402/544* (2013.01); *B65H 2402/631* (2013.01); *B65H 2402/632* (2013.01); *B65H 2402/80* (2013.01); *B65H 2404/134* (2013.01); *B65H 2404/1431* (2013.01); *B65H 2404/54* (2013.01); *B65H 2801/03* (2013.01)

(58) Field of Classification Search
CPC . B65H 5/062; B65H 5/06; B65H 5/38; B65H 2402/531; B65H 2402/544; B65H 2402/631; B65H 2402/632; B65H 2402/63
See application file for complete search history.

(56) References Cited

U.S. PATENT DOCUMENTS 9,599,951 B2 * 3/2017 Yamaguchi ..... G03G 21/1604
9,710,989 B2 * 7/2017 Matsuoka ..... B65H 5/066
2014/0124334 A1 * 5/2014 Sado ..... B65H 5/062 198/604

FOREIGN PATENT DOCUMENTS

JP 10035936 A * 2/1998
JP 11139612 A * 5/1999
JP 2001151376 A 6/2001
JP 2002070841 A * 3/2002
(Continued)

*Primary Examiner* — Luis A Gonzalez
(74) *Attorney, Agent, or Firm* — Canon U.S.A., Inc. IP Division

(57) ABSTRACT

A sheet conveyance device includes a driving rotation device, a driven rotation device, and a supporting device including first and second restriction surfaces and supporting the driven rotation device. The driving rotation device rotates by receiving rotational driving force and drives the driven rotation device to rotate at a position facing the driving rotation device. The driven rotation device includes a driven rotation member contacting the driving rotation device, a cylindrical shaft having a cylindrical shape that rotatably supports the driven rotation member, and a restriction member that is at least partially inserted in an inner circumference side of the cylindrical shaft. A position of the cylindrical shaft is restricted in a width direction crossing the sheet conveyance direction by the restriction member contacting the first restriction surface, and movement of the cylindrical shaft in a rotational direction is restricted by the restriction member contacting the second restriction surface.

15 Claims, 11 Drawing Sheets

(56) References Cited

FOREIGN PATENT DOCUMENTS

| | | | | |
|---|---|---|---|---|
| JP | 2008265958 | A | * | 11/2008 |
| JP | 2009265533 | A | * | 11/2009 |
| JP | 201111900 | A | | 1/2011 |
| JP | 2015143553 | A | | 8/2015 |

* cited by examiner

SHEET CONVEYANCE DEVICE AND IMAGE FORMING APPARATUS

BACKGROUND OF THE INVENTION

Field of the Invention

The present disclosure relates to a sheet conveyance device for conveying a sheet.

Description of the Related Art

An image forming apparatus, such as a printer, a copying machine, and a facsimile machine, includes a sheet conveyance device. The sheet conveyance device conveys a sheet, on which an image is to be formed, to an image forming unit. The conveyance device also conveys a sheet, on which an image has been formed by the image forming unit, to be discharged from the image forming apparatus. Typically, a sheet conveyance unit includes a driving rotation device (driving roller) that is rotated by a driving unit, and a driven rotation device that is driven by the rotation of the driving rotation device to rotate at a position facing the driving rotation device. The driven rotation device includes a roller and a metal shaft. The metal shaft is inserted through a hole provided in the roller. The roller is biased to contact the driving rotation device, via the metal shaft.

Typically, a metal shaft of a solid round bar has been used for such a purpose. A metal shaft (cylindrical shaft) with a hollow structure, formed by bending a metal plate into a cylindrical shape, has also been proposed to achieve a lighter weight and a lower material cost.

However, such a metal shaft with a hollow structure is formed by bending a metal plate in such a manner that end portions of the metal plate abut against each other, and therefore a gap or stepped portion is likely to be formed between the end portions along the shaft direction. Such a gap or stepped portion affects a sliding property, and thus needs to be prevented from sliding on another member such as a roller.

Japanese Patent Application Laid-Open No. 2015-143553 discusses a configuration as a countermeasure for preventing the gap or stepped portion from sliding on another member as described above. The configuration features bearings, to be biased in one direction, supporting both ends of a metal shaft (cylindrical shaft). The cylindrical shaft engages with the bearings to prevent from be rotated.

SUMMARY OF THE INVENTION

According to an aspect of the present invention, a sheet conveyance device includes a driving rotation device configured to rotate by receiving rotational driving force from a driving unit, a driven rotation device configured to be driven by the driving rotation device to rotate at a position facing the driving rotation device, and a supporting device including a first restriction surface and a second restriction surface in an outside area of the driven rotation device in a sheet conveyance direction, and configured to support the driven rotation device, wherein the driven rotation device includes a driven rotation member contacting the driving rotation device, a cylindrical shaft made of metal and having a cylindrical shape and configured to rotatably support the driven rotation member, and a restriction member that is at least partially inserted in an inner circumference side of the cylindrical shaft, and wherein a position of the cylindrical shaft is restricted in a width direction crossing the sheet conveyance direction by the restriction member contacting the first restriction surface, and movement of the cylindrical shaft in a rotational direction is restricted by the restriction member contacting the second restriction surface.

Further features of the present invention will become apparent from the following description of embodiments with reference to the attached drawings.

DESCRIPTION OF THE EMBODIMENTS

Modes for carrying out the embodiments are described in detail below based on embodiments, with reference to the drawings. It is to be noted that sizes, materials, and shapes of components described in the embodiments as well as the positional relationship among the components may be changed as appropriate in accordance with a configuration and various conditions of a device or an apparatus employing an embodiment. Thus, the scope is not to be limited by the embodiments described below.

An image forming apparatus according to a first embodiment is described in detail below with reference to the drawings. The following description is given with a printer employed as one embodiment of the image forming apparatus. Note that the embodiment of the image forming apparatus is not limited to this. For example, the present embodiment can be applied to other image forming apparatuses such as a copying machine and a FAX machine, or a multifunction peripheral (MFP) having functions of the printer, the copying machine, the facsimile machine, and the like.

Figure 5:
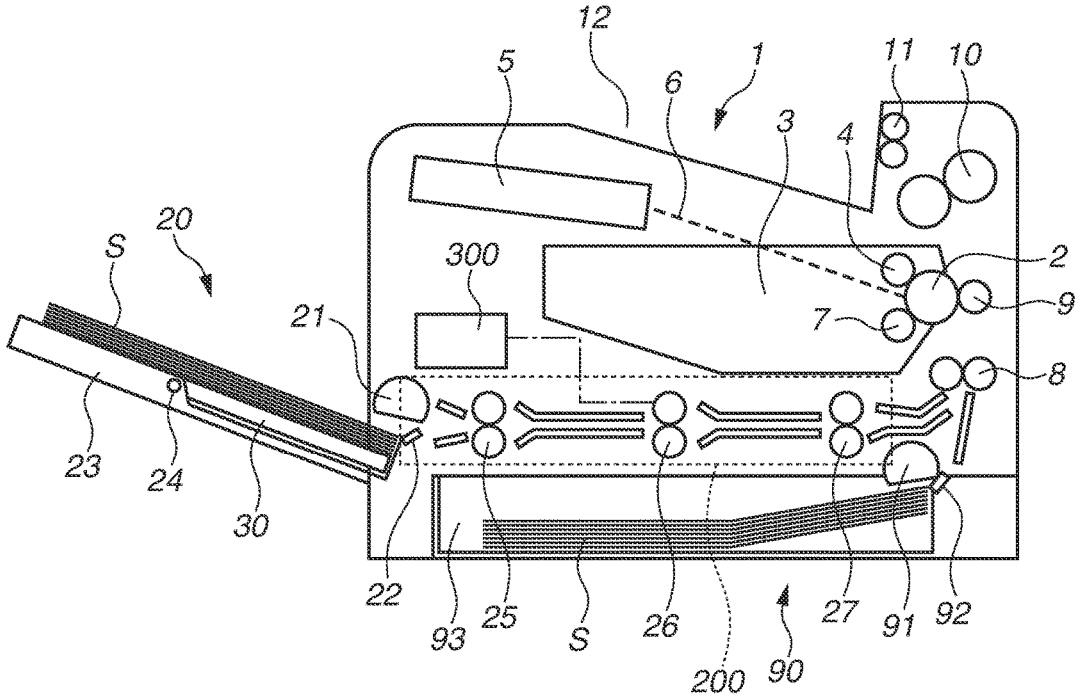
FIG. 5 is a schematic view illustrating a configuration of an image forming apparatus according to the first embodiment.

FIG. 5 is a schematic view illustrating a configuration of an image forming apparatus 1. In FIG. 5, the image forming apparatus 1 includes a photosensitive drum 2 serving as an image bearing member and provided in a process cartridge 3 (image forming unit) that contains black developer (toner), in a state of being rotatably supported by the process cartridge 3 at both end portions. The photosensitive drum 2 receives driving force from a driving motor and a driving force transmission unit via one of the end portions to be driven and rotated in a counterclockwise direction in FIG. 5. The photosensitive drum 2 has a surface, which is coated with an organic photoconductive layer, uniformly charged with a charging roller 4 by supplying charging bias thereto. The photosensitive drum 2 is selectively exposed to a laser beam 6 emitted from a laser scanner unit 5 serving as an exposure unit, whereby an electrostatic latent image is formed. The electrostatic latent image is developed to be a toner image by a developing unit 7 attaching toner onto the electrostatic latent image.

A first sheet feeding unit 20 includes a sheet feeding roller 21, a separation pad 22, a sheet feeding tray 23, and a sheet stack plate 30. Sheets S are stacked on the sheet feeding tray 23 and on the sheet stack plate 30. The sheet feeding roller 21 is driven to rotate by a driving motor and a driving force transmission unit (not illustrated) at a predetermined timing. The sheet stack plate 30 is rotated about a pivot point 24 by a driving motor and a driving force transmission unit (not illustrated) at a predetermined timing, to bring the sheet S into contact with the sheet feeding roller 21. Thus, the sheets S are fed by the sheet feeding roller 21 and the sheet stack plate 30 operating as described above. In this process, one of the sheets S is separated from the other sheets, due to frictional force of the separation pad 22, to be conveyed to a pair of conveyance rollers 25 and thus reaches a sheet conveyance device 200. The sheet conveyance device 200 (see FIG. 5) includes at least one pair of conveyance rollers to convey the sheet S. The sheet conveyance device 200 according to the present embodiment includes the pair of conveyance rollers 25, a pair of conveyance rollers 26, and a pair of conveyance rollers 27.

The sheet S that has reached the sheet conveyance device 200 as described above is then conveyed to the pair of conveyance rollers 26, the pair of conveyance rollers 27, and a pair of registration rollers 8 in this order. The pair of registration rollers 8 conveys the sheet S to a transfer position where the photosensitive drum 2 is in contact with a transfer roller 9. At the transfer position, the toner image on the photosensitive drum 2 is transferred onto the sheet S by the transfer roller 9 to which a predetermined bias voltage is applied.

The sheet S on which the toner image has been transferred is conveyed to a pair of fixing rollers 10 that applies heat and pressure to the sheet S, so that the toner image is fused and fixed on the sheet S. Thus, an image is formed. The sheet S conveyed by the pair of fixing rollers 10 passes through a pair of discharge rollers 11 to be discharged and stacked onto a discharge tray 12.

The image forming apparatus 1 further includes a second sheet feeding unit 90. The second sheet feeding unit 90 includes a sheet feeding roller 91, a separation pad 92, and a sheet feeding cassette 93. The sheets S are stacked on the sheet feeding cassette 93. The sheets S are fed by the sheet feeding roller 91 driven by the driving motor serving as a driving source (not illustrated) and a driving force transmission unit at a predetermined timing. In this process, one of the sheets S is separated from the other sheets due to the frictional force of the separation pad 92 and fed to the pair of registration rollers 8. Then, the sheet S is conveyed to the transfer position where the photosensitive drum 2 and the transfer roller 9 are in contact with each other. Then, the sheet S is conveyed, in a manner similar to that of the sheet S fed from the first sheet feeding unit 20, to be discharged and stacked onto the discharge tray 12. In addition, a side where the first sheet feeding unit 20 is provided in FIG. 5 is a front surface side of the image forming apparatus 1.

Figure 2:
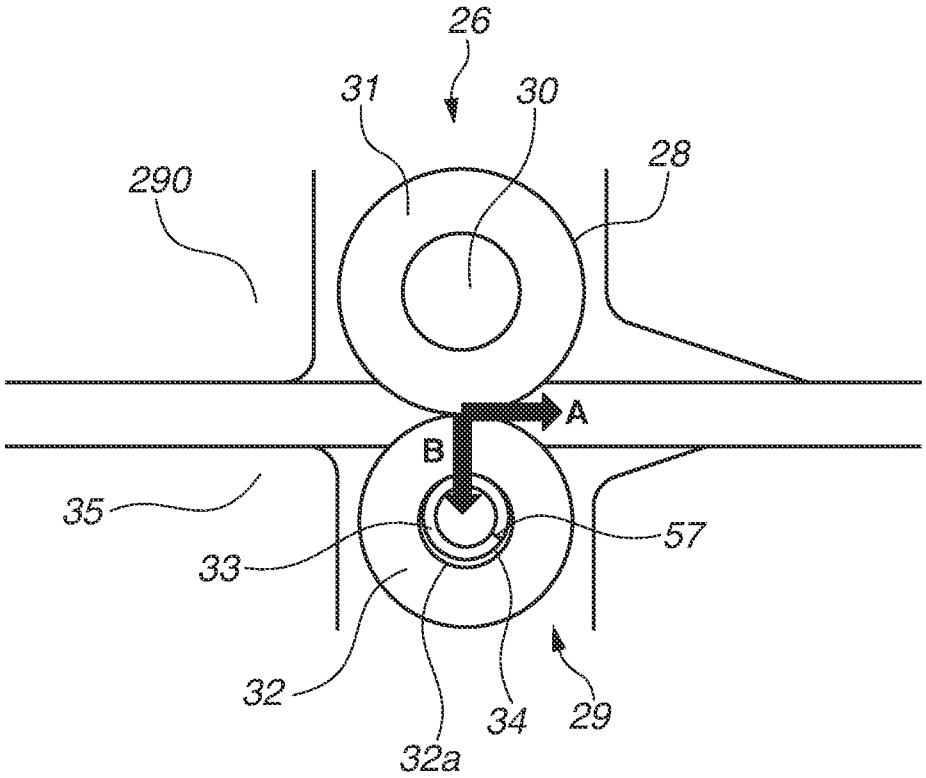
FIG. 2 is a cross-sectional view illustrating a pair of conveyance rollers according to the first embodiment.

FIG. 2 is an enlarged view of the pair of conveyance rollers 26 illustrated in FIG. 5. The pair of conveyance rollers 25 and the pair of conveyance rollers 27 have the same configuration as the pair of conveyance rollers 26 and thus are omitted in the description.

As illustrated in FIG. 2, the pair of conveyance rollers 26 conveys a sheet with a conveyance roller 28 serving as the driving rotation device and a roller 32 of a driven rotation device 29. The conveyance roller 28 includes a roller shaft 30 supported by an upper conveyance guide 290 fixed to an apparatus main body and a rubber member 31 fixed to the roller shaft 30. A driven gear (not illustrated) is provided at one end of the roller shaft 30 and engaged with a driving unit 300 provided to the apparatus main body. The conveyance roller 28 receives driving force from the driving unit 300 to rotate in the counterclockwise direction.

The driven rotation device 29 includes a cylindrical shaft 33 having a shape of a metal cylinder and a roller 32 serving as a driven rotation member that is rotatable relative to the cylindrical shaft 33. The roller 32 is positioned to face the rubber member 31 and has a through hole 32*a* into which the cylindrical shaft 33 is inserted. The roller 32 can rotate relative to the cylindrical shaft 33 serving as a rotational shaft, while being in contact with the rubber member 31.

The cylindrical shaft 33 is biased by a torsion spring 36 (biasing member) described below to press the roller 32 toward the rubber member 31. When the conveyance roller 28 rotates in the counterclockwise direction, the roller 32 is driven to rotate in a clockwise direction due to the frictional force produced between the rubber member 31 and the roller 32. In this process, the roller 32 receives the frictional force in a rotation direction as indicated by an arrow A and the counter force as indicated by an arrow B from the rubber member 31. Thus, a small gap 34 is formed at a lower right position in FIG. 2 between the through hole 32*a* and the cylindrical shaft 33. The sheet S fed by the first sheet feeding unit 20 is conveyed through a space between the upper conveyance guide 290 and a lower conveyance guide 35 (supporting device) supported by the apparatus main body. The pair of conveyance rollers 26 nips the sheet S that is conveyed thereto with the conveyance roller 28 and the roller 32, and conveys the sheet S by the rotation of the conveyance roller 28 and the roller 32.

Figure 3:
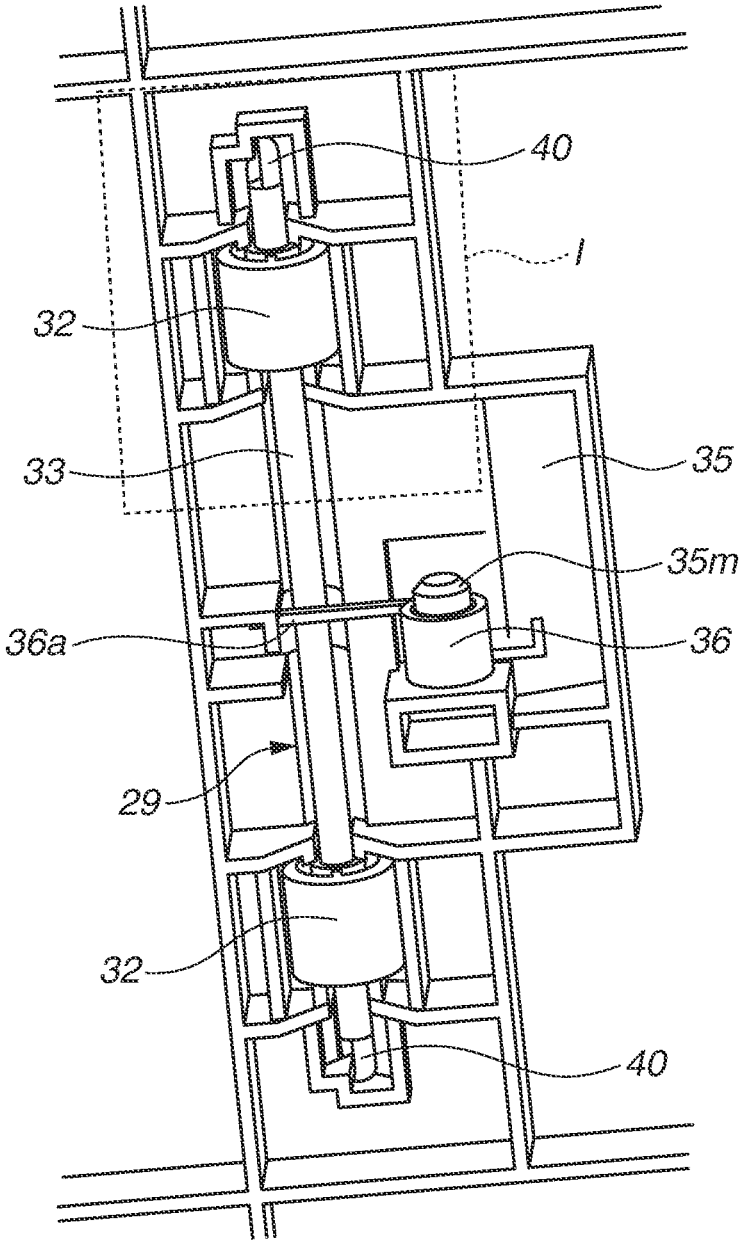
FIG. 3 is a diagram illustrating a driven rotation device according to the first embodiment as viewed from an upper side.

FIG. 3 is a diagram illustrating the pair of conveyance rollers 26 as viewed from the diagonally lower side of the device and the driven rotation unit 29 side. The driven rotation unit 29 according to the present embodiment is provided with two rollers 32 (first driven rotation member and second driven rotation member) positioned to be symmetrical with each other about the center of a width direction of the sheet S. The cylindrical shaft 33 has both ends each provided with a restriction member that is at least partially (insertion portion) inserted in the inner circumference side of the cylindrical shaft 33. In the present embodiment, a cap 40, made of resin such as polyacetal, is provided as the restriction member. The torsion spring 36 is supported by a boss portion 35*m* that is formed integrally with the lower conveyance guide 35, and has an arm portion 36*a* in contact with a center portion of the cylindrical shaft 33 in the longitudinal direction. The torsion spring 36 applies the biasing force to press the roller 32 against the rubber member 31 via the cylindrical shaft 33.

Figure 1:
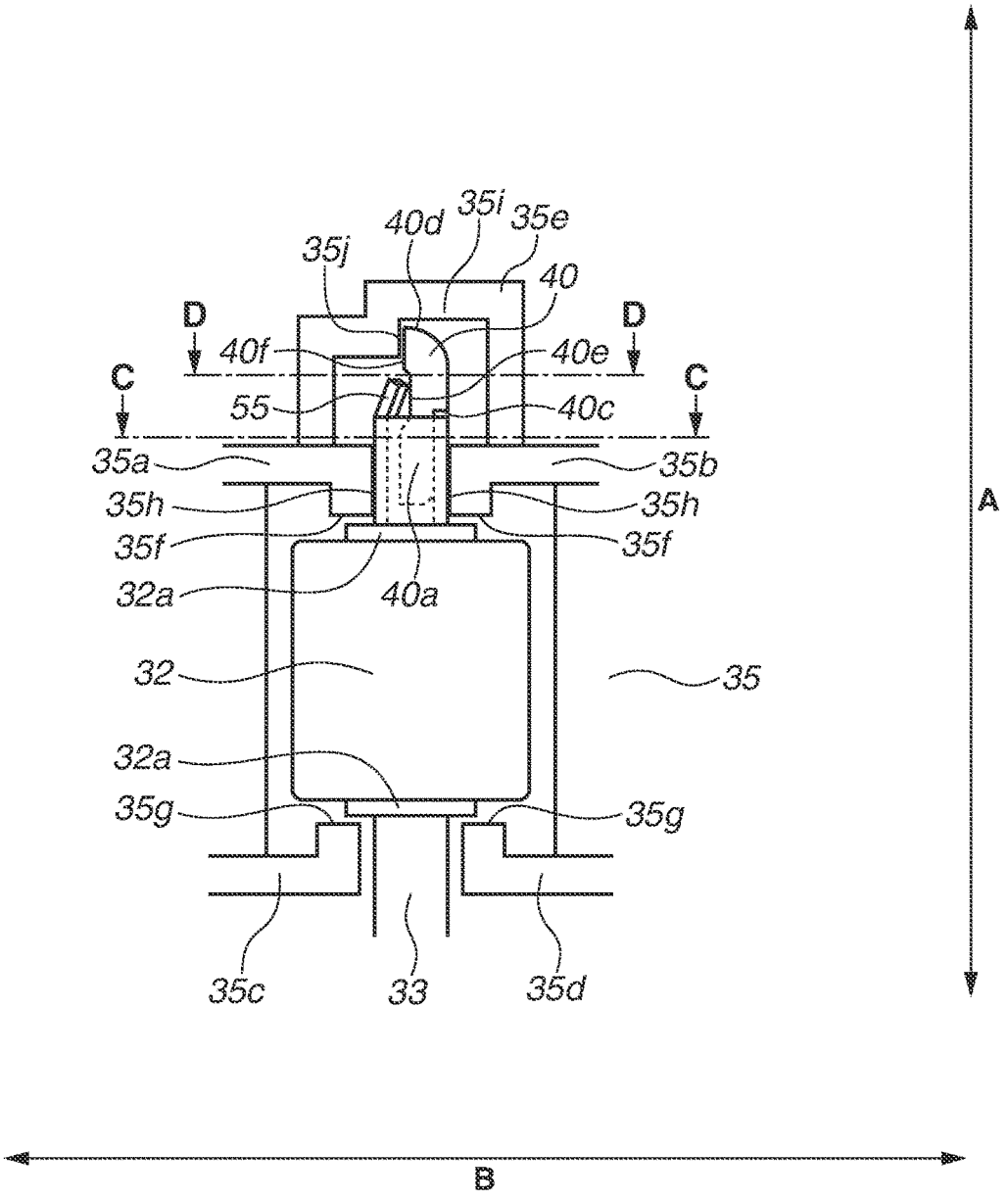
FIG. 1 is a diagram illustrating a configuration of a restriction member according to a first embodiment and a periphery thereof.

FIG. 1 is a diagram illustrating the cap 40 and is an enlarged view of an area around the roller 32 serving as the first driven rotation member. This area is defined by a dotted line I in FIG. 3. The roller 32 serving as the first driven rotation member is described below. Since the second driven rotation member and the cap 40 for the second driven rotation member illustrated on the lower side in FIG. 3 have the same configuration, and thus are not described. A direction A in FIG. 1 indicates the width direction crossing a sheet conveyance direction, and a direction B indicates the sheet conveyance direction.

The roller 32 includes roller protrusion portions 32*a* formed integrally at both ends. The lower conveyance guide 35, serving as a supporting device that supports the driven rotation device 29, is provided with a rib 35*a*, a rib 35*b*, a rib 35*c*, and a rib 35*d* that are formed integrally therewith. The rib 35*a*, the rib 35*b*, the rib 35*c*, and the rib 35*d* have portions where roller restriction surfaces 35*f* and roller restriction surfaces 35*g* for restricting the position of the roller are formed. The roller restriction surface 35*f* and the roller restriction surface 35*g* are separated from each other by a distance slightly larger than a distance between the two roller protrusion portions 32*a*.

The roller 32 has its position restricted in the longitudinal direction of the cylindrical shaft 33 (width direction crossing the sheet conveyance direction) by the roller restriction surfaces 35*f* and the roller restriction surfaces 35*g* with a slight. Shaft supporting surfaces 35*h* are formed on the rib 35*a* and the rib 35*b* to support the cylindrical shaft 33 at both ends thereof, and restricts the position of the cylindrical shaft 33 in the conveyance direction of the sheet S.

Figure 4A:
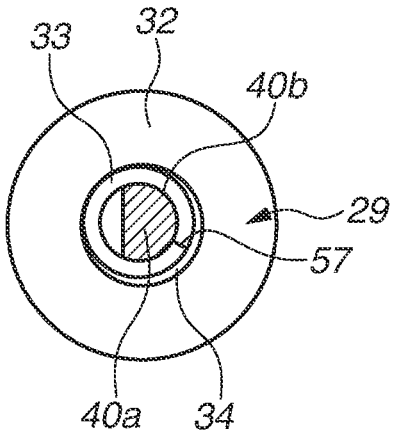
FIGS. 4A and 4B are cross-sectional views illustrating relationship between the restriction member and a cylindrical shaft according to the first embodiment.

FIG. 4A is a cross-sectional view taken along line C-C in FIG. 1. A cap protrusion portion 40*a* cut to have a shape of the letter D is inserted in the cylindrical shaft 33 and an arc portion 40*b* thereof fits to an inner circumference surface of the cylindrical shaft 33.

A cap stepped portion 40*c* (see FIG. 1) is formed on the cap 40. An end surface of the cylindrical shaft 33 in the longitudinal direction comes into contact with the cap stepped portion 40*c*. The lower conveyance guide 35 has a rib 35*e* formed integrally therewith. The rib 35*e* has a portion where a thrust restriction surface 35*i*, serving as a first restriction surface, is formed. The thrust restriction surface 35*i* is positioned in an area on the outer side of the cylindrical shaft 33 in the width direction of the cylindrical shaft 33. A cap distal end 40*d* comes into contact with the thrust restriction surface 35*i* to have its position restricted in the longitudinal direction of the cylindrical shaft 33. The movement of the cylindrical shaft 33 is restricted in the longitudinal direction by contacting the thrust restriction surface 35*i* via the cap stepped portion 40*c* and the cap distal end 40*d*.

Figure 4B:
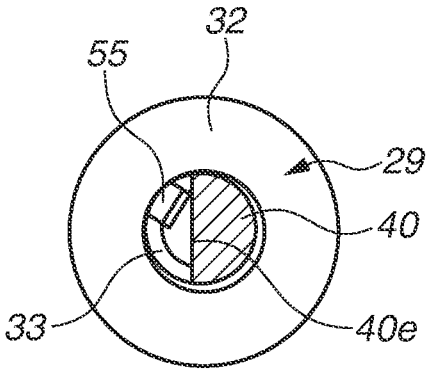

A tab 55 (described below) is formed on the cylindrical shaft 33. The tab 55 is a protruding portion, protruding from the end surface of the cylindrical shaft 33, and needs to be prevented from coming into contact with another member such as the lower conveyance guide 35. FIG. 4B is a cross-sectional view taken along line D-D in FIG. 1. In this cross-sectional view (orthogonal cross section), the cap 40 has an outer diameter not exceeding the outer diameter of the cylindrical shaft 33. A tab contact surface 40*e* formed on the cap 40 restricts the movement of the tab 55 in the rotational direction.

As illustrated in FIG. 1, a cap end flat surface 40*f*, serving as a rotation stopping surface formed on the cap 40, comes into contact with a rotation restriction surface 35*j*, serving as a second restriction surface formed on the rib 35*e*, in the rotational direction. In the configuration described above, the cylindrical shaft 33 comes into contact with the rotation restriction surface 35*j* in the rotational direction, via the tab 55, the tab contact surface 40*e*, and the cap end flat surface 40*f*, so as to restrict the movement in the rotational direction.

In FIG. 4B, when the roller 32 rotates in the clockwise direction, the cylindrical shaft 33 is driven to rotate in the clockwise direction and stops upon reaching a position where the tab 55 comes into contact with the tab contact surface 40*e*. At that time, a joint portion 57 (described below) formed on the side facing the tab 55 of the cylindrical shaft 33 is positioned at a lower right portion in FIG. 4A. As described above, the gap 34, between the roller 32 and the cylindrical shaft 33 is also formed at the lower right portion. Thus, no sliding occurs between the inner circumference surface of the roller 32 and the joint portion 57, whereby the inner circumference surface of the roller 32 can be prevented from being scratched by an edge of the joint portion 57. With the caps 40 having an excellent sliding property and provided on both ends of the cylindrical shaft 33, the tab 55 is not grinded against the lower conveyance guide 35. Thus, the contact force from the roller 32 due to the biasing force from the torsion spring 36 can be stably applied to the conveyance roller 28.

A method for manufacturing the cylindrical shaft 33 is described in detail with reference to FIGS. 6, 7, 8A to 8D, 9A and 9B. The cylindrical shaft 33 is formed by bending a metal plate into a cylindrical shape.

Figure 6:
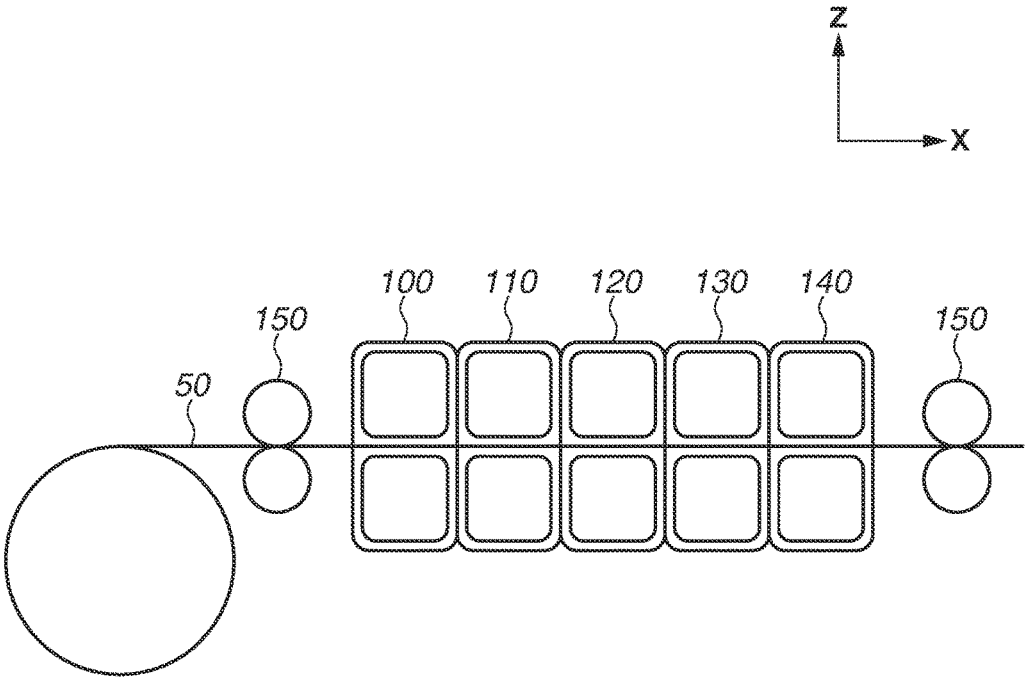
FIG. 6 is a schematic view illustrating a production process and a configuration of a manufacturing apparatus for the cylindrical shaft.

FIG. 6 is a schematic view illustrating a configuration of a manufacturing apparatus for the cylindrical shaft 33. The manufacturing apparatus for the cylindrical shaft 33 includes a conveyance mechanism 150 for conveying a metal plate 50, a punching processing station 100 for performing a punching process on the metal plate 50, processing stations 110, 120 and 130 for perform bending processes on the metal plate 50, and a cutting station 140 for cutting off a part.

The metal plate 50, which is rolled in a coil shape and which has a plate thickness of about 0.4 to 1.2 mm, is wound back and sent to the punching processing station 100 by the conveyance mechanism 150. The punching processing station 100 includes a male mold and a female mold that are used for the punching process. In the punching processing station 100, the metal plate 50 is pressed by the male mold and the female mold, so that an unnecessary portion is cut off removed from the metal plate 50. As a result, the metal plate 50 is formed into a predetermined shape before the bending processes.

Figure 7:
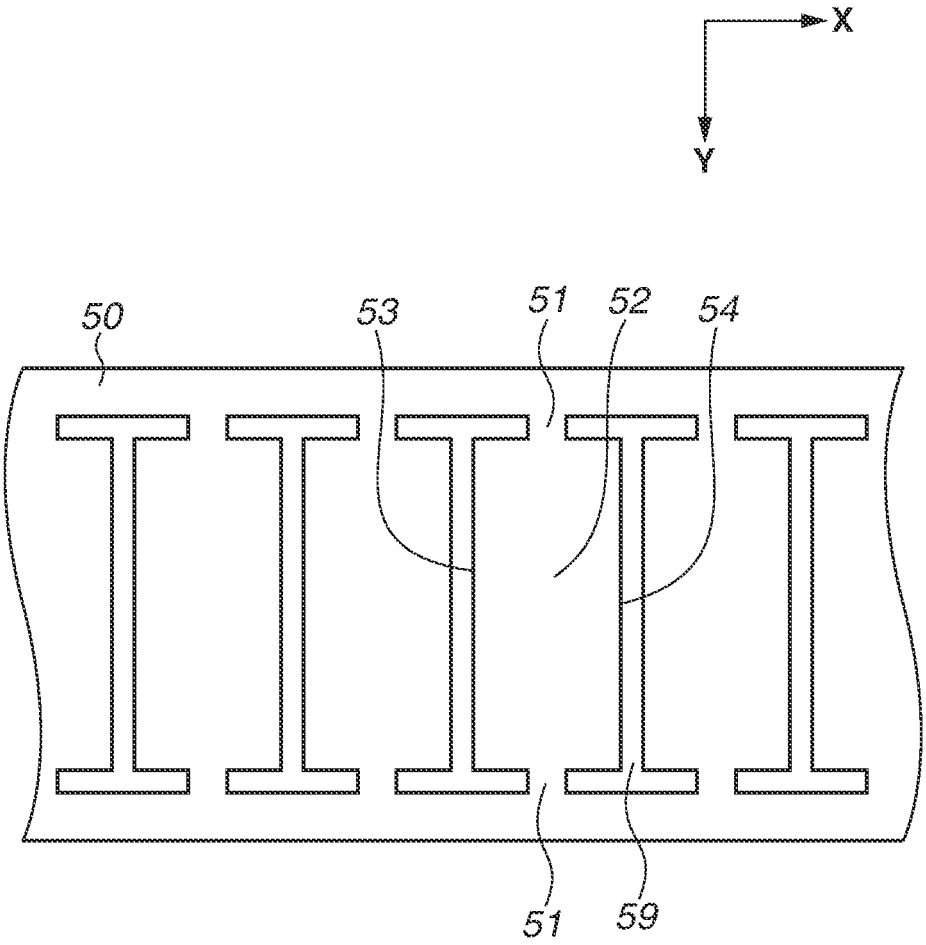
FIG. 7 is a schematic view illustrating a shape of a metal plate after a punching process.

FIG. 7 is a schematic view illustrating a shape of the metal plate 50 after passing through the punching processing station 100. The metal plate 50 is cut off and removed at a plurality of cut-shaped portions 59, which are holes each having an I-shape or an H-shape that is rotated by 90 degrees, at an equal interval. With this punching process, the metal plate 50 is processed to have a shape with a plurality of flat plate portions 52, to be the shaft (cylindrical portion) of the cylindrical shaft 33, connected with a frame portion via connection portions 51. Edge portions 53 and 54, which are end portions of each flat plate portion 52 in a conveyance direction (X direction) of the metal plate 50, are portions to be a joint portion of the cylindrical portion when the flat plate portions 52 are formed into the cylindrical portion by the subsequent bending process. The connection portions 51 are portions to be cut for separating each flat plate portion 52, which has been bent into the cylindrical shape, from the frame portion. A remaining portion to the flat plate portion 52 after the cutting is a portion to be the tab portion 55 in a final product. The metal plate 50 is sequentially subjected to the punching process at the punching processing station 100, so that a plurality of portions having the above-described shape are formed at an equal interval along the conveyance direction.

The bending processes are described with reference to FIGS. 8A, 8B, 8C, and 8D. FIGS. 8A, 8B, 8C, and 8D are schematic views illustrating the bending processes. The bending processing stations 110 to 130 illustrated in FIG. 6 are arranged in the conveyance direction (X direction) of the metal plate 50.

Figure 8A:
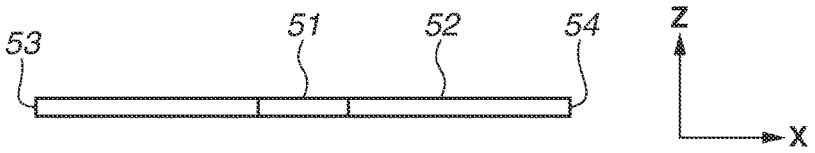
FIGS. 8A, 8B, 8C, and 8D are schematic views illustrating bending processes for producing the cylindrical shaft.
Figure 8B:
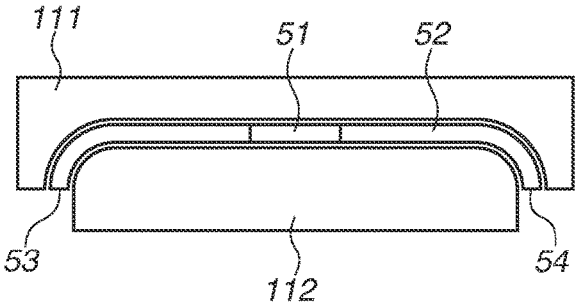
Figure 8C:
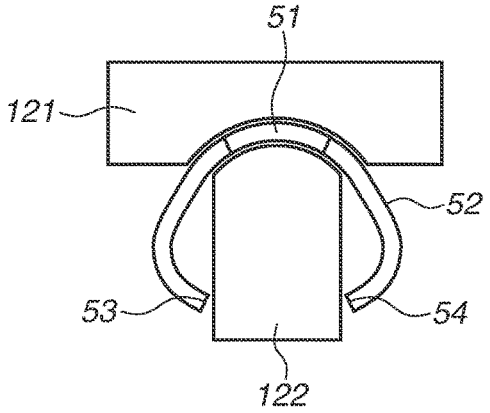

FIG. 8A illustrates one of the flat plate portions 52 of the metal plate 50 after the punching process, as viewed in a Y direction. This flat plate portion 52 is sequentially subjected to three bending processes in the bending processing stations 110 to 130. FIG. 8B is a schematic view illustrating a first bending process. The first bending process is performed by the bending processing station 110. The bending processing station 110 includes a female mold 111 and a male mold 112. The flat plate portion 52 is sandwiched by the female mold 111 and the male mold 112 to make both end portions incline relative to a center portion so as to direct end surfaces of the edge portions 53 and 54 downward. FIG. 8C is a schematic view illustrating a second bending process. The second bending process is performed at the bending processing station 120. The bending processing station 120 includes a female mold 121 and a male mold 122. The flat plate portion 52 bent in the first bending process is further bent by the female mold 121 and the male mold 122 to have the center portion curved.

Figure 8D:
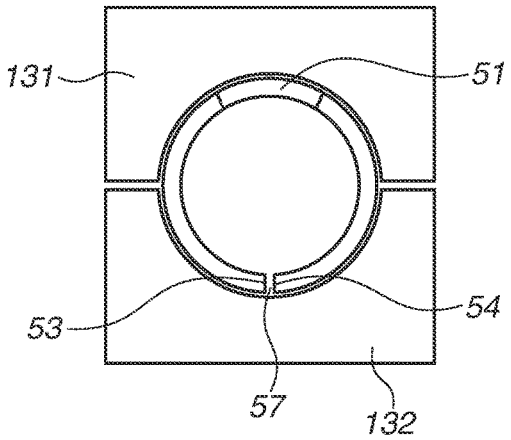

FIG. 8D is a schematic view illustrating a third bending process. The third bending process is performed at the third bending station 130. The third bending station 130 includes a female mold 131 and a male mold 132. The flat plate portion 52 bent in the second bending process is further bent by the female mold 131 and the male mold 132 into a substantially cylindrical shape as a whole, and is processed so as to join the edge portions 53 and 54. The flat plate portion 52 thus bent contacts at the joint portion 57, which is formed by the edge portions 53 and 54 adjacently positioned to each other, to have the substantially cylindrical shape. The joint portion 57 is not limited to the shape formed by contacting the edge portions 53 and 54 with each other. The edge portions 53 and 54 may face each other in the circumference direction with a gap therebetween, and thus a cylindrical portion may not necessarily have a completely continuous shape. When the bending processes described above are completed, the metal plate 50 is in a state where a plurality of the cylindrical shafts 33 is connected to the frame portion via the connection portions 51.

Figure 9A:
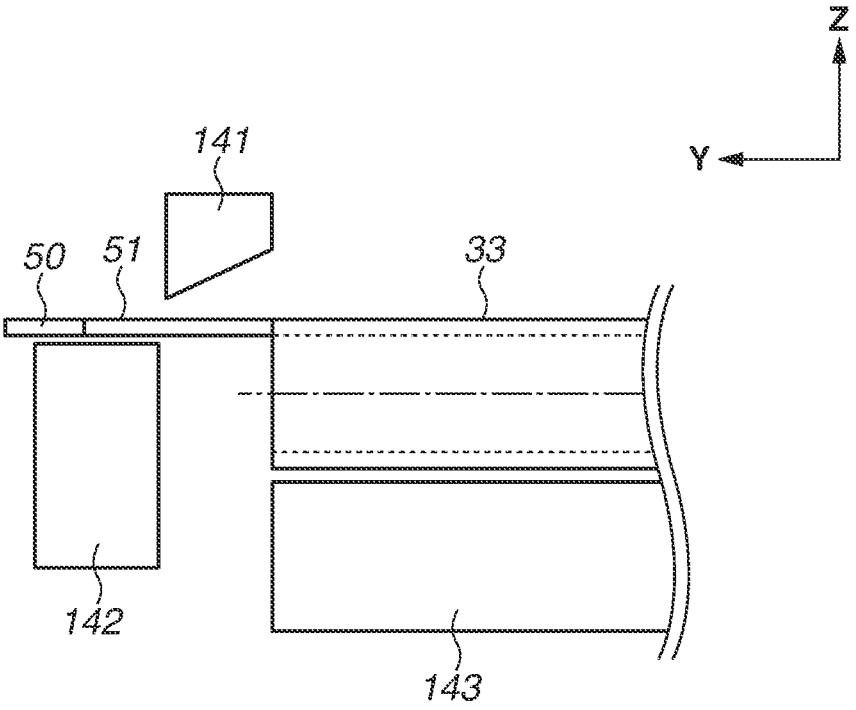
FIGS. 9A and 9B are schematic views illustrating a cutting process for the cylindrical shaft.
Figure 9B:
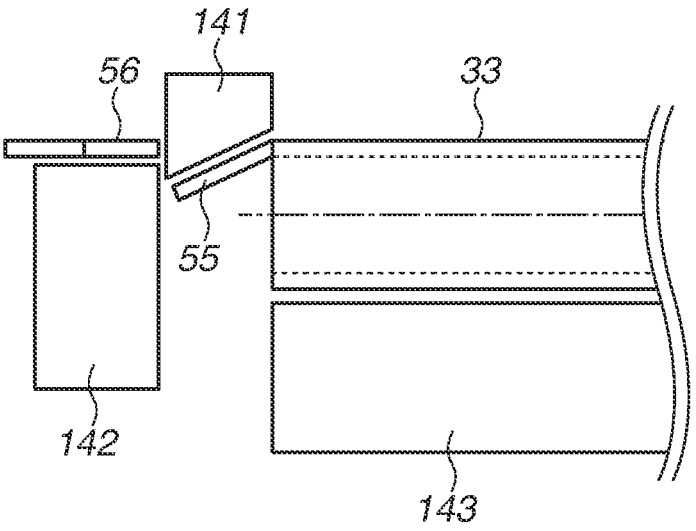

A cutting process of cutting off the cylindrical shaft 33 from the frame portion of the metal plate 50 will be described with reference to FIGS. 9A and 9B. FIGS. 9A and 9B are schematic views of the metal plate 50, after the bending processes described above is completed, as viewed in the conveyance direction. More specifically, the FIGS. 9A and 9B are enlarged views of an area around an end portion on one side in a direction orthogonal to the conveyance direction of the metal plate 50, more specifically, around the connection portion 51. The end portion on the other side has the same configuration as the end portion on the one side, and thus will be omitted in the description. This process includes cutting the cylindrical shaft 33 from the frame portion of the metal plate 50 and the tab portion 55 is formed on the end portion of the cylindrical shaft 33, so that the cylindrical shaft 33 is formed into the final product.

FIG. 9A is a schematic view illustrating a state immediately before the connection portion 51 is cut. The cutting process is performed at the cutting station 140. The cutting station 140 includes metal molds 141, 142 and 143. The metal plate 50 is supported at a lower side of the cylindrical shaft 33 by the metal mold 143 and a lower side of the connection portion 51 by the metal mold 142.

FIG. 9B is a schematic view illustrating a state after the connection portion 51 is cut. The connection portion 51 is cut by lowering the metal mold 141 having a blade at its free end toward the metal plate 50 supported by the metal molds 142 and 143. By lowering the metal mold 141 toward the metal mold 142, the connection portion 51 is cut and thus an edge portion 56 connected with the metal plate 50 and the tab portion 55 are formed. Then, the metal mold 141 is further lowered so that the tab portion 55 is bent toward the center of the cylindrical shaft 33. More specifically, the metal molds 141 and 142, which are a pair of tools, move relative to each other to cut the connection portion 51. At that time, the metal mold 141 is further moved after the connection portion 51 is cut, while a part of the connection portion 51 remains on the cylindrical shaft 33 as the tab portion 55 on the cylindrical shaft 33. As a result, the tab portion 55 is bent at a predetermined angle relative to the cylindrical shaft 33.

As described above, the movement of the cylindrical shaft 33 in the rotational direction and its position on the width direction can be restricted by the cap 40 that can contact the lower conveyance guide 35, without the tab portion 55 of the cylindrical shaft 33 engaging with the lower conveyance guide 35.

As described above, the fitting portion to determine the position with respect to the cylindrical shaft 33 is positioned inside the cylindrical shaft 33, and thus the cap 40 can have a small outer shape. This is particularly effective to downsize the device in a configuration where the cylindrical shaft 33 designed to be short and the cap 40 to be positioned on the inner side of the conveyance guide surface in the width direction, to achieve a lower cost and a lighter weight of the material thereof.

The cap 40 has the outer diameter substantially the same as the diameter of the cylindrical shaft 33, so that the roller 32 can be assembled to the cylindrical shaft 33 after the cap 40 is attached to the cylindrical shaft 33. With this configuration, the inner circumference surface of the roller 32 and the edge of the end portion of the cylindrical shaft 33 can be prevented from being grinded with each other in the assembly process, whereby the roller inner circumference surface can be prevented from being damaged.

The portions around both ends of the cylindrical shaft 33 can be directly supported by parts fixed to the apparatus main body. Therefore, high accuracy of the alignment, in the conveyance direction, of the cylindrical shaft 33 and the roller 32 rotatably supported by the cylindrical shaft 33 can be maintained. As a result, high conveyance accuracy of, for example, sheet skew can be maintained.

Figure 10:
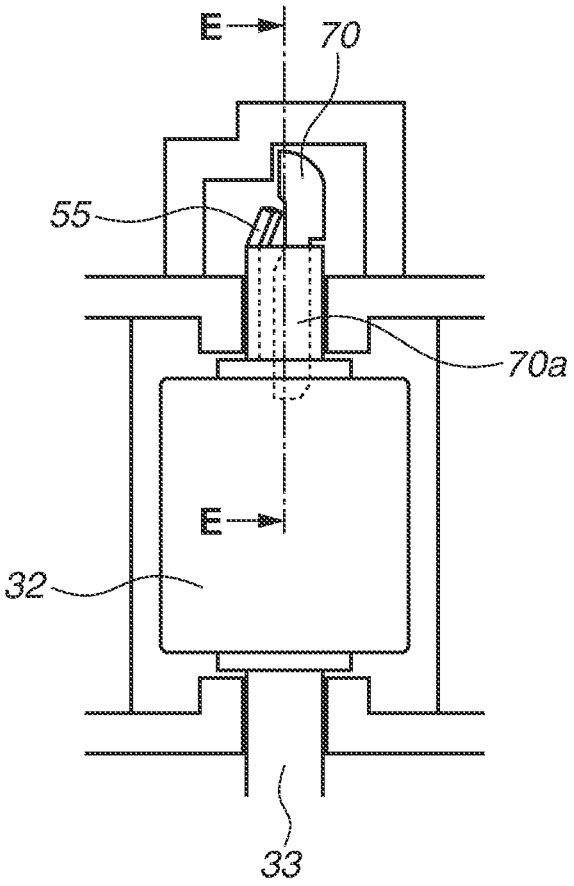
FIG. 10 is a diagram illustrating a configuration of a restriction member according to a second embodiment and a periphery thereof.
Figure 11:
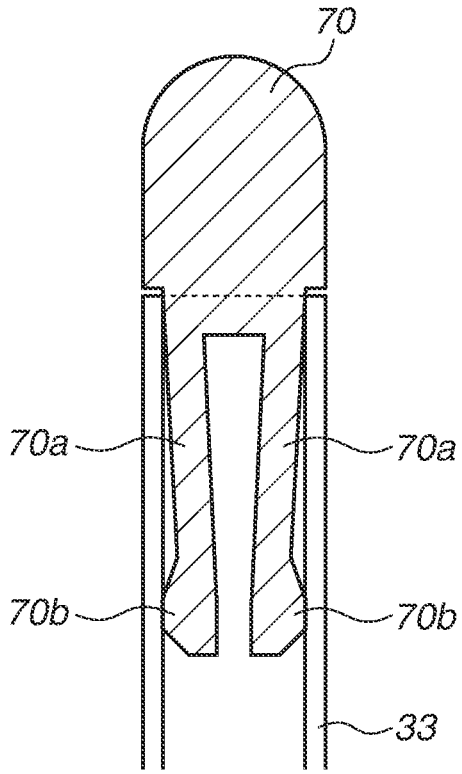
FIG. 11 is a cross-sectional view illustrating a relationship between the restriction member and a cylindrical shaft according to the second embodiment.

A second embodiment is described with reference to FIGS. 10 and 11. A configuration of an image forming apparatus and a method for manufacturing the cylindrical shaft 33 according to the second embodiment are similar to those according to the first embodiment, and thus will be omitted in the description. Matters not specifically described below are similar to those according to the first embodiment.

A cap featured in the second embodiment is described with reference to FIGS. 10 and 11. FIG. 10 is an enlarged view of an area around the roller 32. FIG. 11 is a cross-sectional view taken along line E-E in FIG. 10.

The cap 70, serving as a restriction member, has cap claw portions 70*a* formed integrally therewith. The cap claw portions 70*a* (insertion portion) are inserted in the cylindrical shaft 33. The cap 70 is made of resin such as polyacetal, and the cap claw portions 70*a* is elastically deformable. The cap claw portions 70*a* each have a claw protrusion portion 70*b* integrally formed at a portion around the distal end. The claw protrusion portions 70*b* of the cap claw portions 70*a* in an elastically deformed state contacts the inner circumference surface of the cylindrical shaft 33 with a predetermined biasing force. In this manner, the cap 70 is temporarily held by the cylindrical shaft 33.

In the present embodiment described above, the cap can be temporarily held by the cylindrical shaft, whereby the cap and the roller can be assembled with higher workability.

In the first and the second embodiments described above, examples applied to the sheet conveyance device 200 in the image forming apparatus 1 are described. However, for example, an embodiment can also be applied to a sheet post-processing device that can be connected to the image forming apparatus 1, and performs post processing such as sheet alignment and stapling. An embodiment can also be applied to a driven rotation device provided in an image forming unit in the image forming apparatus 1.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2016-251835, filed Dec. 26, 2016, which is hereby incorporated by reference herein in its entirety.

What is claimed is:

1. A sheet conveyance device comprising:

a driving rotation device configured to rotate by receiving rotational driving force from a driving unit;

a driven rotation device configured to be driven by the driving rotation device to rotate at a position facing the driving rotation device, wherein the driven rotation device conveys a sheet with the rotation from the driving rotation device; and a supporting device including a first restriction surface and a second restriction surface in an outside area of the driven rotation device in a width direction intersecting a sheet conveyance direction, and configured to support the driven rotation device, wherein the driven rotation device includes a driven rotation member contacting the driving rotation device, a cylindrical shaft made of metal and having a cylindrical shape and configured to rotatably support the driven rotation member, and a restriction member that is at least partially inserted in an inner circumference side of the cylindrical shaft, wherein the cylindrical shaft includes a protruding portion protruding from an end surface of the cylindrical shaft in the width direction, and wherein a position of the cylindrical shaft is restricted in the width direction by the restriction member contacting the first restriction surface, and movement of the cylindrical shaft in a rotational direction is restricted by the protruding portion contacting the restriction member and the regulating member contacting the second restriction surface.

2. The sheet conveyance device according to claim 1, wherein the restriction member includes a stepped portion at a position facing the end surface of the cylindrical shaft, and wherein movement of the cylindrical shaft in the width direction is restricted by the stepped portion of the restriction member contacting the end surface of the cylindrical shaft.

3. The sheet conveyance device according to claim 1, wherein the supporting device is configured to rotatably support the cylindrical shaft of the driven rotation device.

4. The sheet conveyance device according to claim 1, wherein the restriction member includes an insertion portion to be inserted in an inner circumference side of the cylindrical shaft, and wherein the insertion portion comes into contact with an inner circumference surface of the cylindrical shaft by elastic deformation.

5. The sheet conveyance device according to claim 1, wherein the restriction member has an outer diameter that does not exceed an outer diameter of the cylindrical shaft in a cross section orthogonal to an axis of the cylindrical shaft.

6. The sheet conveyance device according to claim 1, wherein the cylindrical shaft is biased toward the driving rotation device by a biasing member included in the supporting device.

7. The sheet conveyance device according to claim 1, wherein the cylindrical shaft is formed by bending a metal plate into a cylindrical shape.

8. An image forming apparatus comprising:

an image forming unit configured to form an image on a sheet; and a sheet conveyance device configured to convey the sheet to the image forming unit, wherein the sheet conveyance device includes:

a driving rotation device configured to rotate by receiving a-rotational driving force from a driving unit, a driven rotation device configured to be driven by the driving rotation device to rotate at a position facing the driving rotation device, wherein the driven rotation device conveys a sheet with the rotation from the driving rotation device, and a supporting device including a first restriction surface and a second restriction surface in an outside area of the driven rotation device in a width direction intersecting a sheet conveyance direction, and configured to support the driven rotation device, wherein the driven rotation device includes a driven rotation member contacting the driving rotation device, a cylindrical shaft made of metal and having a cylindrical shape and configured to rotatably support the driven rotation member, and a restriction member that is at least partially inserted in an inner circumference side of the cylindrical shaft, wherein the cylindrical shaft includes a protruding portion protruding from an end surface of the cylindrical shaft in the width direction, and wherein a position of the cylindrical shaft is restricted in the width direction by the restriction member contacting the first restriction surface, and movement of the cylindrical shaft in a rotational direction is restricted by the protruding portion contacting the restriction member and the regulating member contacting the second restriction surface.

9. The image forming apparatus according to claim 8, wherein the restriction member includes a stepped portion at a position facing the end surface of the cylindrical shaft, and wherein movement of the cylindrical shaft in the width direction is restricted by the stepped portion of the restriction member contacting the end surface of the cylindrical shaft.

10. The image forming apparatus according to claim 8, wherein the supporting device is configured to rotatably support the cylindrical shaft of the driven rotation device.

11. The image forming apparatus according to claim 8, wherein the restriction member includes an insertion portion to be inserted in an inner circumference side of the cylindrical shaft, and wherein the insertion portion comes into contact with an inner circumference surface of the cylindrical shaft by elastic deformation.

12. The image forming apparatus according to claim 8, wherein the restriction member has an outer diameter that does not exceed an outer diameter of the cylindrical shaft in a cross section orthogonal to an axis of the cylindrical shaft.

13. The image forming apparatus according to claim 8, wherein the cylindrical shaft is biased toward the driving rotation device by a biasing member included in the supporting device.

14. The image forming apparatus according to claim 8, wherein the cylindrical shaft is formed by bending a metal plate into a cylindrical shape.

15. The image forming apparatus according to claim 8, wherein the supporting device is provided on a guide portion to guide the sheet.

* * * * *